US008156598B2

(12) United States Patent
McDowell

(10) Patent No.: US 8,156,598 B2
(45) Date of Patent: Apr. 17, 2012

(54) PERSONAL HYGIENE DEVICES TO AID PHYSICALLY IMPAIRED USERS TO CLEAN THEIR RECTO-GENITAL AREA

(76) Inventor: Karen S. McDowell, Darien, IL (US)

( * ) Notice: Subject to any disclaimer, the term of this patent is extended or adjusted under 35 U.S.C. 154(b) by 1779 days.

(21) Appl. No.: 11/015,768

(22) Filed: Dec. 20, 2004

(65) Prior Publication Data

US 2010/0058551 A1 Mar. 11, 2010

(51) Int. Cl.
*A47K 7/08* (2006.01)

(52) U.S. Cl. ..... 15/104.94; 15/222; 401/8; 601/137; 601/143; 604/1; 604/289

(58) Field of Classification Search ..... 15/104.94, 15/210.1, 222; 401/6–8; 601/136–138, 143; 604/1, 289, 312, 364
See application file for complete search history.

(56) References Cited

U.S. PATENT DOCUMENTS

| | | | | |
|---|---|---|---|---|
| 922,108 A | | 5/1909 | Dunn | |
| 1,345,026 A | | 6/1920 | Riley | |
| 1,990,568 A | * | 2/1935 | Scheidler | 15/222 |
| 2,544,354 A | | 3/1951 | Reiter | |
| 2,691,787 A | * | 10/1954 | Rosenwein | 15/118 |
| 3,364,511 A | * | 1/1968 | Martin | 15/222 |
| 3,396,406 A | | 8/1968 | Gongwer | |
| 3,654,929 A | * | 4/1972 | Nilsson et al. | 604/364 |
| 3,875,933 A | | 4/1975 | Schwab et al. | |
| 3,959,841 A | * | 6/1976 | Horne | 15/104.94 |
| 4,349,288 A | | 9/1982 | Bond | |

(Continued)

FOREIGN PATENT DOCUMENTS

DE 10155380 * 12/2002

(Continued)

OTHER PUBLICATIONS

Written Opinion and International Search Report dated Sep. 17, 2007 for PCT Application PCT/US06/23735.

(Continued)

*Primary Examiner* — Mark Spisich
(74) *Attorney, Agent, or Firm* — James P. Muraff; Neal, Gerber & Eisenberg LLP

(57) ABSTRACT

Personal hygiene devices designed to aid physically impaired persons to clean their own recto-genital area following urination, defecation, menstruation, or sweating. The devices include an elongated flexible strip made from one or two elongated individual sheets affixed together and of a length sufficient to extend between the user's legs and of a width sufficient to generally cover the recto-genital area. The strip has an absorbent middle portion for engaging the user's recto-genital area and respective dependent end portions having respective thumb holes therethrough for easy gripping in-hand. An absorbent pad is positioned at the middle portion retained by the individual sheets to increase the absorbency thereof. The device is used by gripping the end portions in-hand optionally using the thumb holes with the middle portion extending between the user's legs. The middle portion is moved into engagement with the user's recto-genital area and the end portions moved longitudinally while maintaining tension thereon to wipe the middle portion along the recto-genital area to remove excrement therefrom. The device is made of flushable materials for disposal down toilets following use. The devices are preferably manufactured in device sheets from rolls of raw materials using automated manufacturing equipment in which the devices are initially interconnected at perforated tear lines and subsequently separated, folded or wrapped, and individually wrapped or otherwise packaged for individual use thereof.

6 Claims, 6 Drawing Sheets

U.S. PATENT DOCUMENTS

Figure 1:
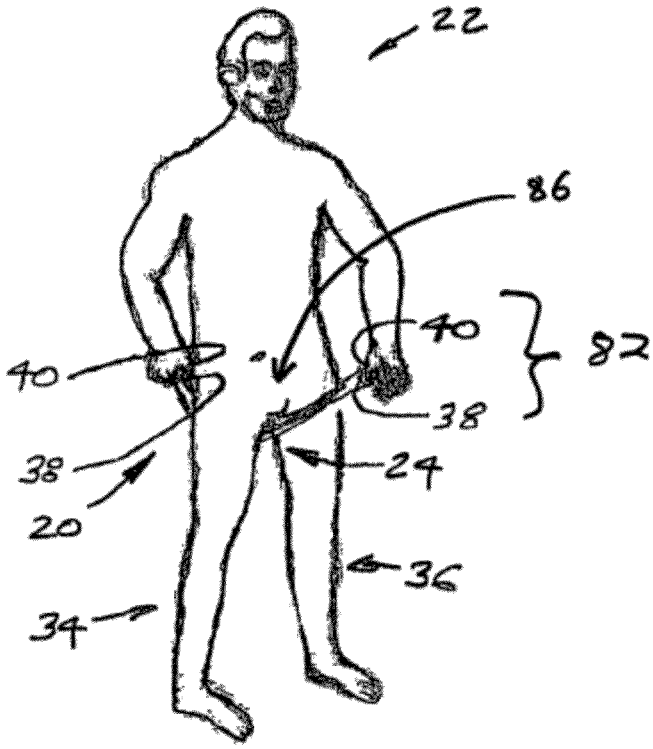

| | | | | | |
|---|---|---|---|---|---|
| 4,422,205 | A | * | 12/1983 | Braxter, Sr. | 15/222 |
| 4,672,707 | A | | 6/1987 | Johnson | |
| 4,754,652 | A | | 7/1988 | Coulter | |
| 4,974,730 | A | | 12/1990 | Deruysscher | |
| 4,987,632 | A | * | 1/1991 | Rowe et al. | 15/104.93 |
| 5,251,990 | A | | 10/1993 | Vought et al. | |
| 5,745,949 | A | * | 5/1998 | Pine | 15/244.1 |
| 5,862,564 | A | | 1/1999 | Hamm | |
| 6,145,154 | A | | 11/2000 | Blair | |
| 6,272,716 | B1 | | 8/2001 | Thornton | |
| 6,386,776 | B2 | | 5/2002 | Scariano | |
| 2002/0042598 | A1 | * | 4/2002 | Reese | 604/358 |
| 2005/0241093 | A1 | * | 11/2005 | McKenzie | 15/209.1 |

FOREIGN PATENT DOCUMENTS

| | | | |
|---|---|---|---|
| FR | 2672788 | * | 8/1992 |
| JP | 7-236591 | * | 9/1995 |
| JP | 2000-126269 | * | 5/2000 |
| WO | WO 2007001955 | | 1/2007 |

OTHER PUBLICATIONS

International Preliminary Report on Patentability dated Dec. 24, 2007.

* cited by examiner

PERSONAL HYGIENE DEVICES TO AID PHYSICALLY IMPAIRED USERS TO CLEAN THEIR RECTO-GENITAL AREA

BACKGROUND OF THE INVENTION

1. Field

The present invention relates generally to hand-held personal hygiene devices for cleaning a user's recto-genital area such as following urination, defecation, menstruation, or sweating, and more specifically to such personal hygiene devices which are designed to assist obese, physically challenged, arthritic, and elderly persons to clean their own recto-genital region.

2. State of the Art

Removal of excretory matter from the recto-genital area such as urine following urination, fecal matter following defecation, menses following menstruation, or sweat following sweating by wiping with toilet paper is an important daily activity for healthy individuals which is often taken for granted. Fecal matter which remains on the skin of the recto-genital area following defecation is high in bacteria and viruses and smells bad. The remaining fecal matter causes symptoms including itching, irritation, chafing, and the like. Even worse, infections are possible such as when the person has a pre-existing anal medical condition such as hemorrhoids and the like where the recto-genital skin has openings through which the bacteria and viruses can enter. Likewise, feces and urine contain bacteria and viruses that can cause recto-genital infections in men and women and urinary tract infections in women if not removed following defecation or urination.

The removal of excretory matter from the recto-genital area is particularly troublesome for persons who are obese, arthritic, palsied, or suffer from specific physical disabilities. Such persons may not be able to hold the toilet paper in-hand due to arthritic hands or tremors, reach their recto-genital area due to a lack of range of motion of the arms and/or shoulders to reach behind or in front of themselves particularly to reach their anal region, and/or difficulty in manipulating the toilet paper to effect proper cleaning. Therefore, they may require assistance from another person to effect proper cleaning. This can be embarrassing for the recipient and unsavory for the care giver. Likewise, removal of other excretory matter such as sweat from the recto-genital area is difficult for such persons. Sweat is particularly troublesome for obese persons who sit a lot such as at their job.

In an effort to solve the problem, various mechanical devices have been patented to assist the person to reach their recto-genital area. In U.S. Pat. No. 6,145,154 issued to Blair on Nov. 14, 2000 is disclosed a personal hygiene device for persons having a physical disability to holding a wash cloth or toilet paper for washing and wiping various parts of the person's body that are difficult to reach due to the physical disability. The personal hygiene device includes respective first and second tubes that fit together telescopically for extending and retracting the device, and a clamping device at a distal end of the second tube adapted for holding the wash cloth or toilet paper for wiping the person's body. Similarly, a hand-held device for gripping toilet paper is disclosed in U.S. Pat. No. 6,272,716 issued to Thornton on Aug. 14, 2001. The device includes a pair of opposing jaws that are attached to one end of a curved tubular body with a handle at an opposite end for gripping in-hand. The handle has a push button for actuating the jaws.

While these mechanical devices are generally suitable for the purpose intended, they suffer from several substantial drawbacks. They are difficult to grip in-hand, particularly by persons having arthritic hands. They are quite long yet gripped only at one end providing poor visibility and leverage so it is difficult to place the toilet paper into proper position at the recto-genital area, apply proper pressure, and manipulate to wipe the recto-genital area. They are subject to contamination since the device is re-used, with the contaminated toilet paper being manually removed by hand following wiping and re-loading with fresh toilet paper. They are not compact so as to be portable in a discrete manner such as for use at public restrooms. Finally, they are relatively expensive to manufacture.

There is a need for a personal hygiene device to aid physically impaired users to clean their recto-genital area which: 1) is easy to grip in-hand and use even by persons having arthritic hands; 2) is easy to place the toilet paper into proper position at the recto-genital area, apply proper pressure, and manipulate to wipe the recto-genital area; 3) is completely disposable so as not to be subject to contamination, preferably being flushing down the toilet; and 4) is compact so as to be portable in a discrete manner; and 5) is inexpensive to manufacture using inexpensive materials and automated manufacturing equipment.

SUMMARY OF THE INVENTION

The present invention is a personal hygiene device to aid physically impaired users to clean their recto-genital area and a hygiene device sheet for production from rolls of raw materials using automated manufacturing equipment.

The personal hygiene device comprises an elongated flexible strip which includes an absorbent middle portion adapted to engage the recto-genital area. Respective dependent end portions are adapted to be gripped in-hand by the user. The strip is of a length sufficient for the middle portion to extend between the user's legs and of a width sufficient to generally cover the recto-genital area. The personal hygiene device is used by gripping the end portions in-hand with the middle portion extending from front to back between the user's legs, moving the middle portion into engagement with the recto-genital area, and moving the end portions longitudinally while maintaining tension thereon to wipe the middle portion along the recto-genital area to remove excrement therefrom.

In a plurality of preferred personal hygiene devices, the strip comprises one or more elongated individual sheets which include respective end portions adapted to be gripped in-hand interconnected by a middle portion. An elongated absorbent pad adapted to provide additional absorbency to the middle portion is retained at the middle portion of the strip. The pad and the central compartment are relatively thin and of a substantially rectangular shape. The ends are folded over and affixed together to form respective reinforced ends with respective thumb holes therethrough adapted to receive respective of the user's thumbs therethrough. The strip is preferably between about thirty and forty-two inches long and between about one and one-half inches and two and one-half inches wide, and the pad is preferably between about twelve inches and twenty inches long. The individual sheets and the pad are each made substantially of flushable materials. The personal hygiene device is used in the manner described above except that the gripping of the end portions in-hand is done with the option of the user's thumb being inserted through the thumb holes for ease of gripping.

The plurality of preferred personal hygiene devices include a first preferred personal hygiene device in which the strip comprises a pair of the individual sheets. The middle portions thereof are affixed together at respective longitudinally extending side seams. The end portions thereof are affixed together to form an elongated central compartment therebetween adapted to contain the pad. In a second preferred personal hygiene device, the strip comprises one of the individual sheets which is doubled-over on itself along a longitudinal fold. The end portions thereof are affixed together. The middle portion thereof is affixed to itself at a longitudinally extending side seam to form an elongated central compartment therebetween adapted to contain the pad. In a third preferred personal hygiene device, the strip comprises an elongated, thin walled tube which includes respect end portions interconnected by a middle portion. The tube is flattened with the end portions affixed together to form an elongated central compartment therebetween adapted to contain the pad. The tube comprises one of the individual sheets which is affixed to itself at a longitudinally extending side seam to form a tubular configuration. In a fourth preferred personal hygiene device, the strip comprises one of the individual sheets with the pad affixed to the middle portion thereof.

The hygiene device sheet comprises a plurality of personal hygiene devices of the types described in which adjacent of the personal hygiene devices are initially interconnected edgewise at respective weakened tear lines adapted to permit separation of the personal hygiene devices therealong for individual use thereof. The individual sheets are formed from rolls of raw sheet material initially interconnected edgewise at respective of the tear lines. The pads are formed from rolls of raw padding material initially interconnected edgewise at respective of the tear lines for manufacture and subsequently separated for individual use thereof. The hygiene device sheets are preferably made more compact or compacted by folding and/or rolling up. The compacted personal hygiene devices may be individually packaged for dispensing by consumers from a dispenser. Each personal hygiene device is used as described above.

THE DRAWINGS

Figure 2:
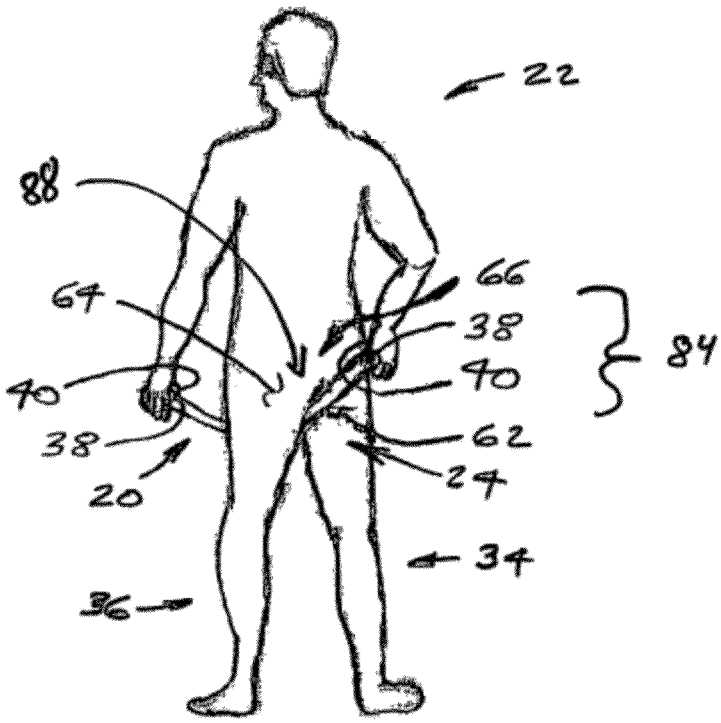
Figure 3:
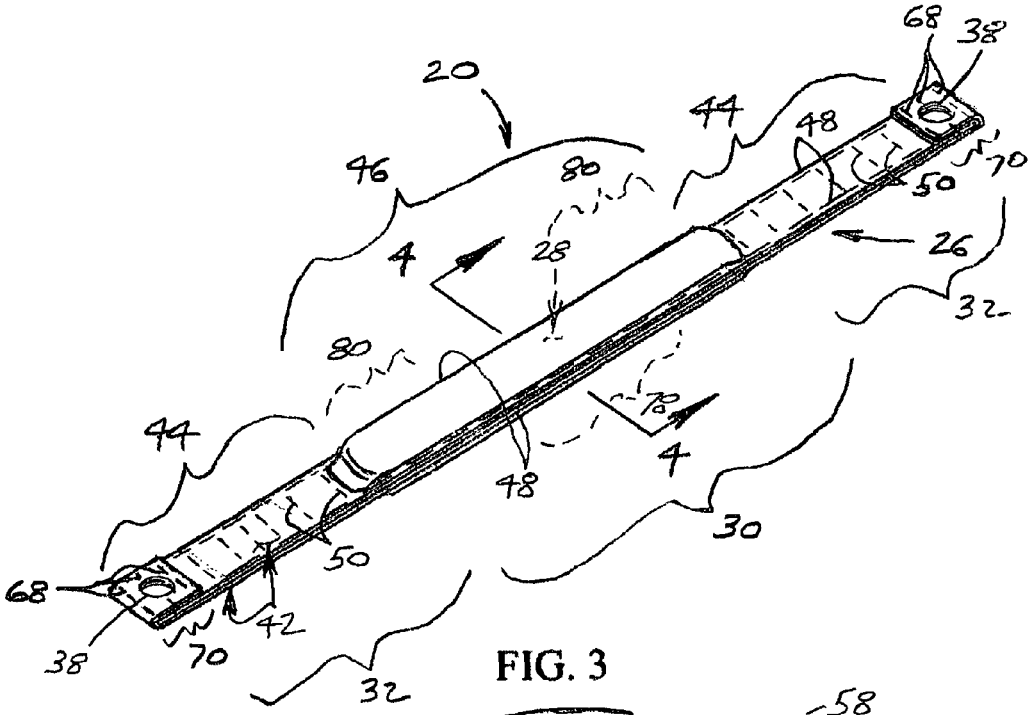
Figure 4:
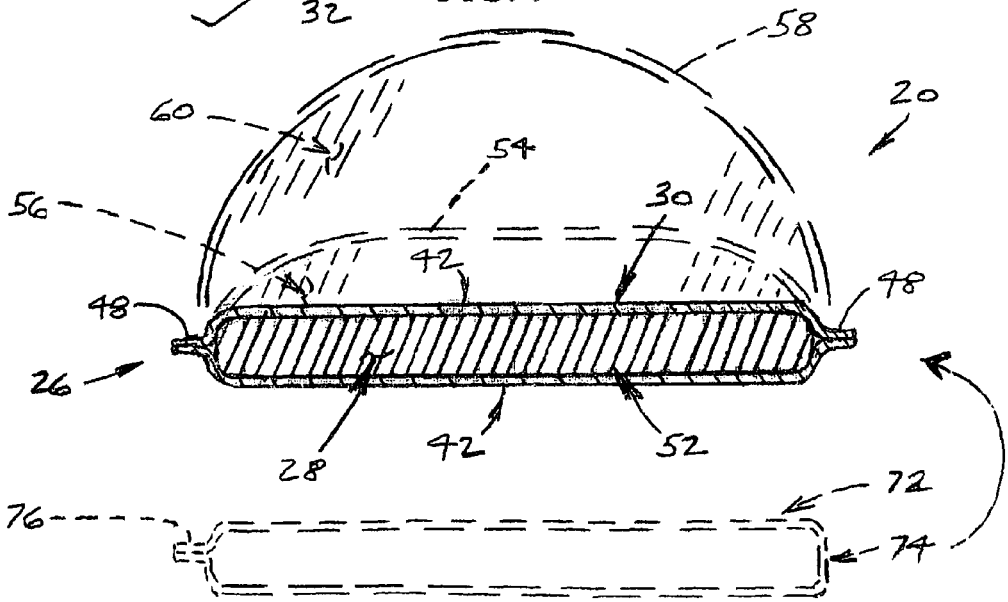
Figure 5:
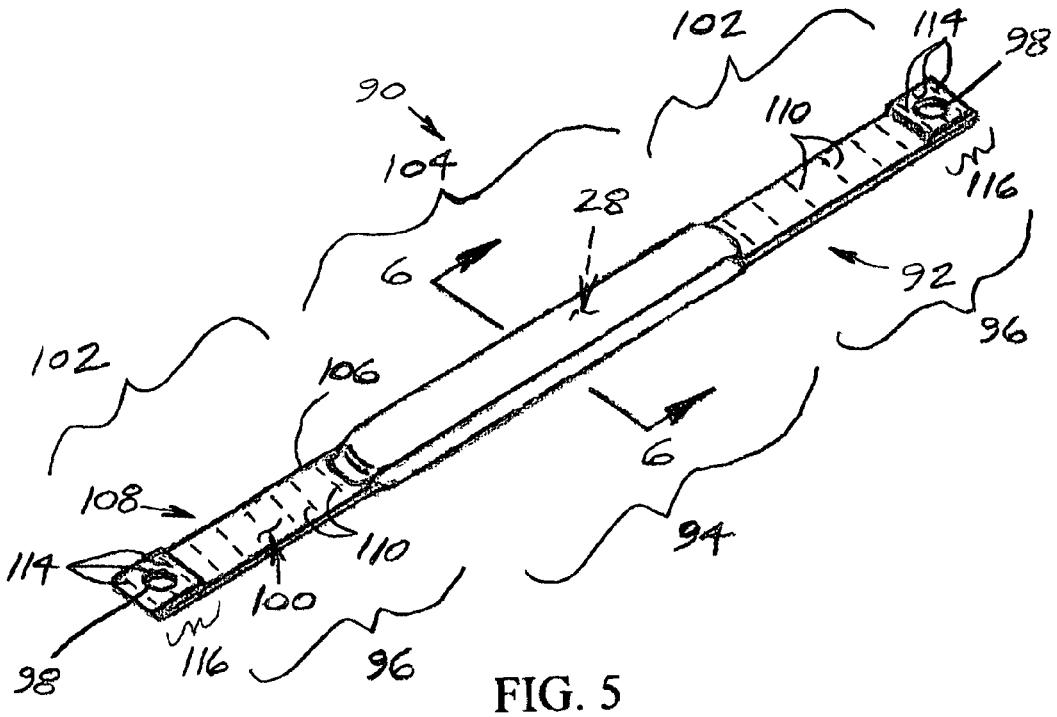
Figure 6:
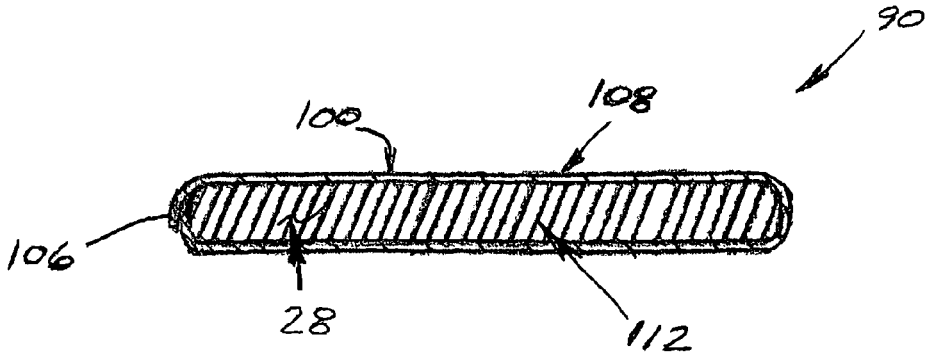
Figure 7:
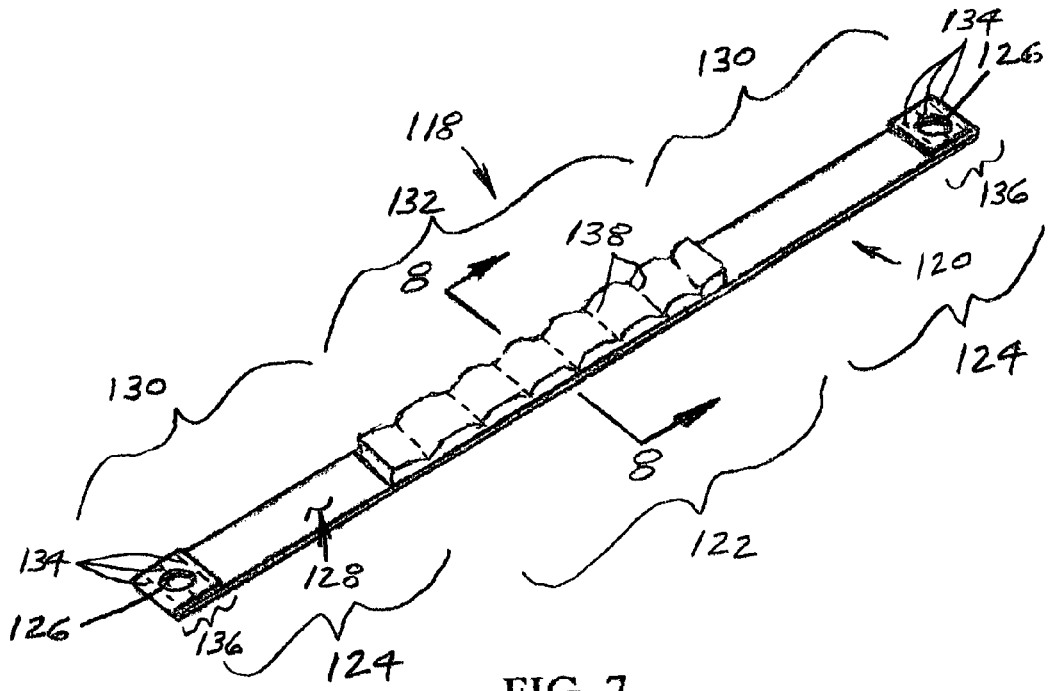
Figure 8:
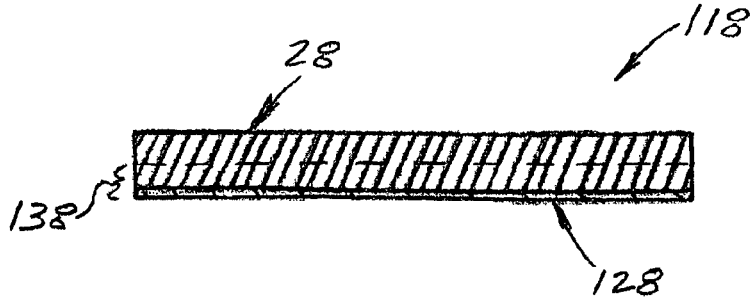
Figure 9:
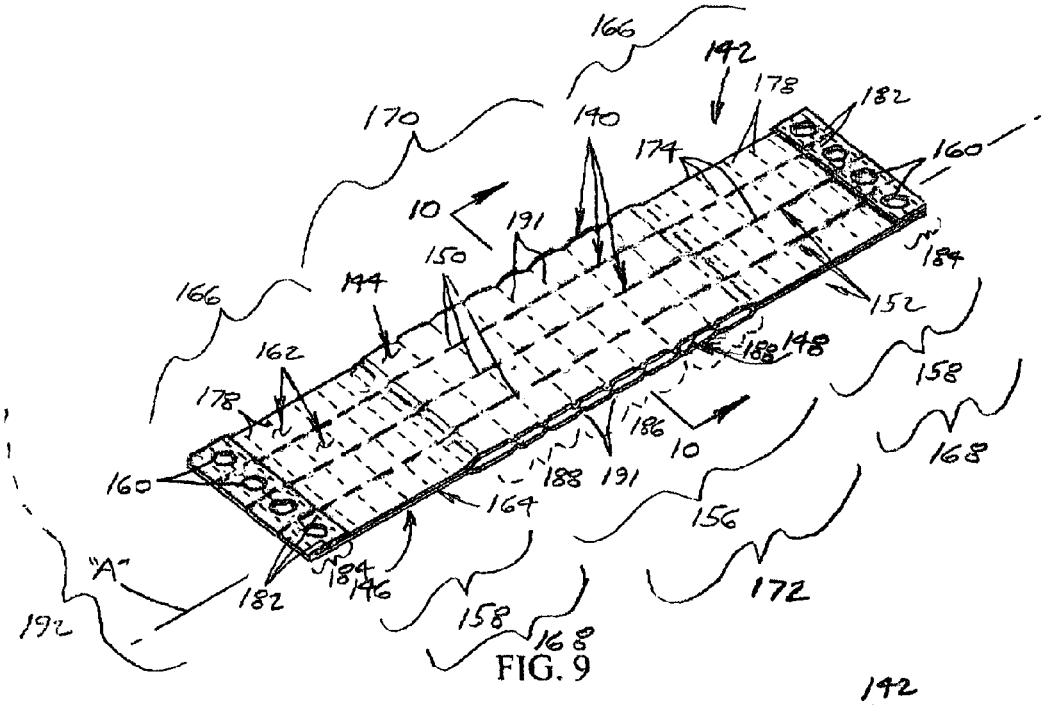
Figure 10:
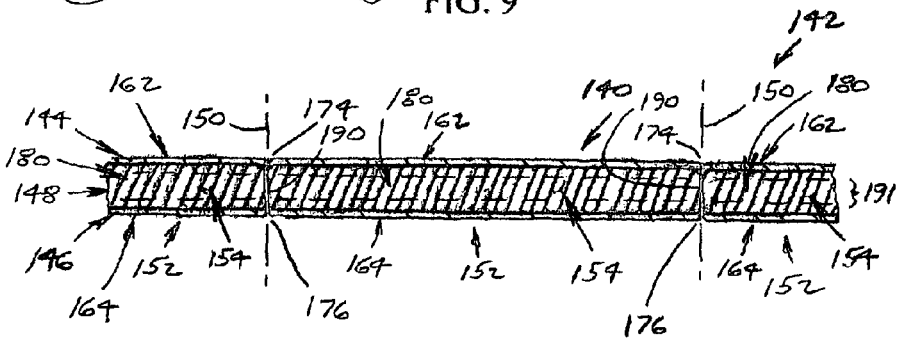
Figure 11:
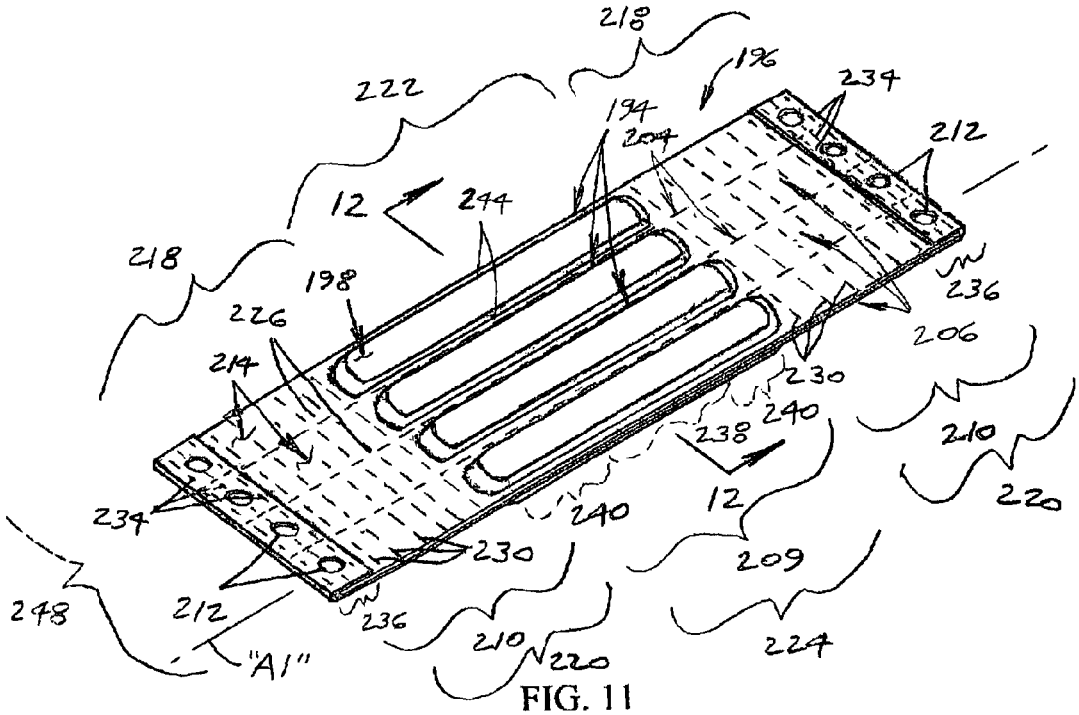
Figure 12:
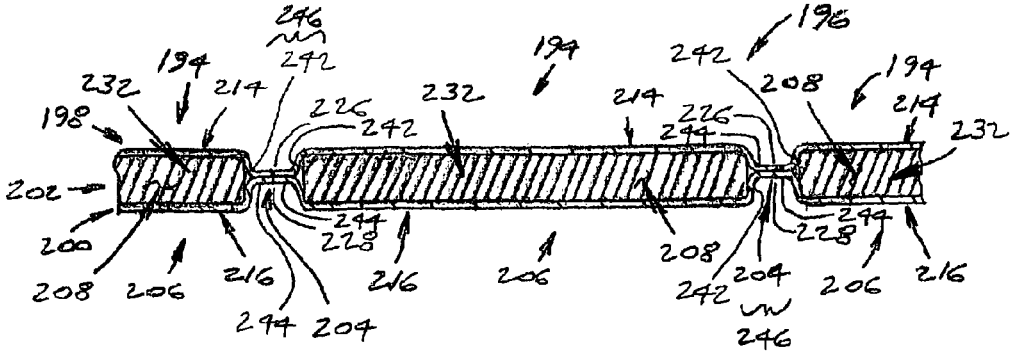

The best mode presently contemplated for carrying out the invention is illustrated in the accompanying drawings, in which:

FIG. 1 is a front perspective view of a person using a first embodiment personal hygiene device of the present invention to clean the recto-genital area, the personal hygiene device having an elongated flexible strip with an absorbent middle portion and dependent end portions each having a thumb hole therethrough for easy thumb gripping, and an elongated absorbent pad to enhance the absorbency of the middle portion;

FIG. 2, a rear perspective view of the person using the personal hygiene device to clean the recto-genital area;

FIG. 3, a perspective view of the personal hygiene device to an enlarged scale showing the flexible strip is comprised of a pair of elongated individual sheets with a pair of reinforced ends having respective thumb holes therethrough, and the absorbent pad retained within a central compartment formed between the individual sheets, with other pad configurations shown in dotted outline;

FIG. 4, a lateral vertical sectional view of the personal hygiene device to a further enlarged scale taken on the line 4-4 of FIG. 3 showing the pad retained within the central compartment between the individual sheets;

FIG. 5, a perspective view of a second embodiment personal hygiene device to the enlarged scale showing an elongated flexible strip comprised of a single elongated individual sheet formed into a flattened tube with a pair of reinforced ends having respective thumb holes therethrough, and the absorbent pad retained within a central compartment formed within the individual sheet;

FIG. 6, a lateral vertical sectional view of the personal hygiene device to the further enlarged scale taken on the line 6-6 of FIG. 5 showing the pad retained within in the central compartment of the individual sheet;

FIG. 7, a perspective view of a third embodiment personal hygiene device to the enlarged scale showing an elongated flexible strip comprised of a single elongated individual sheet, and the absorbent pad affixed to individual sheet;

FIG. 8, a lateral vertical sectional view of the personal hygiene device to the further enlarged scale taken on the line 8-8 of FIG. 7 showing the pad affixed to the individual sheet;

FIG. 9, a perspective view of a plurality of fourth embodiment personal hygiene devices separably interconnected edgewise at a plurality of weakened perforated tear planes to form a hygiene device sheet to the enlarged scale, each personal hygiene device including an elongated flexible strip comprised of a pair of elongated individual sheets with a pair of reinforced ends having respective thumb holes therethrough, and an absorbent pad retained within a central compartment formed between the individual sheets;

FIG. 10, a fragmentary lateral vertical sectional view of the hygiene device sheet to the further enlarged scale taken on the line 10-10 of FIG. 9 showing the pads retained within in the central compartments of the individual sheets;

FIG. 11, a perspective view of a plurality of fifth embodiment personal hygiene devices separably interconnected edgewise at a plurality of perforated lines to form a hygiene device sheet to the enlarged scale, each personal hygiene device including an elongated flexible strip comprised of a pair of elongated individual sheets with a pair of reinforced ends having respective thumb holes therethrough, and an absorbent pad retained within a central compartment formed between the individual sheets; and FIG. 12, a fragmentary lateral vertical sectional view of the hygiene device sheet to the further enlarged scale taken on the line 12-12 of FIG. 11 showing the pads retained within in the central compartments of the individual sheets.

DETAILED DESCRIPTION OF THE ILLUSTRATED EMBODIMENTS

Referring to FIGS. 1 and 2, therein is shown a first embodiment personal hygiene device of the present invention, designated generally at 20, designed to aid physically impaired users such as a person 22 to clean their recto-genital area 24 following excretion such as defecation, urination, menstruation, or sweating.

Referring to FIGS. 3 and 4, the personal hygiene device 20 is of flexible construction comprised of an elongated flexible strip 26 and an elongated absorbent pad 28. The strip 26 includes an absorbent middle portion 30 (i.e. is liquid pervious so as to permit liquids such as urine, liquid feces, menses, or sweat to readily penetrate through its thickness) adapted to engage the recto-genital area 24, and respective dependent end portions 32 adapted to be gripped in-hand by the person 22. The strip 26 as well as those which follow is of a length sufficient for the middle portion 30 to extend between the person's legs 34 and 36 such as between about thirty to forty-two inches long, preferably about thirty-six inches long. Likewise, the strip 26 as well as those which follow is of a width sufficient to generally cover the recto-genital area such that most or all of the recto-genital area may be cleaned in one pass thereof, typically between about one and one-half inches and two and one-half inches wide depending on size of the user. This width also comfortably fits between the person's legs 34 and 36. The end portions 32 are adapted to be gripped in-hand having respective thumb holes 38 therethrough adapted to receive respective of the user's thumbs 40 therethrough.

The strip 26 is comprised of a pair of elongated individual sheets 42 which include respective end portions 44 adapted to be gripped in-hand interconnected by a middle portion 46 adapted to retain the absorbent pad 28. The individual sheets 42, as well as those in the embodiments of the personal hygiene devices which follow are preferably made of a flushable material that is compliant, soft feeling, and non-irritating to the person's skin. Flushable, as used in the present invention, means in terms of the materials that each is of a type which is suitable for flushing down a toilet into the sewer system, and in terms of the whole personal hygiene device that it is of a size including length, width, and thickness which usually doesn't clog toilets upon flushing. Suitable flushable and non-flushable materials include woven and non-woven materials such as: cellulosic and other natural fibers such as wood or cotton fibers to make paper tissue and paper toweling; synthetic fibers such as polyester, polyamide, polyethylene, polypropylene, polyethyleneterepthalate, rayon, polyolefins, combinations of such materials with cellulosic fibers; and other combinations of natural and synthetic fibers. Non-woven materials may be manufactured using any of a number of known processes such as spunbonded, carded, wet-laid, melt-blown, hydro-entangled, resin-bonded, combinations thereof and other suitable processes.

The individual sheets 42, particularly the middle portions 46, are affixed together at respective longitudinally extending side seams 48, and the end portions 44 thereof are affixed together at respective pluralities of transverse intermediate seams 50 to form an elongated central compartment 52 therebetween which is relatively thin and of substantially rectangular shape adapted to contain the absorbent pad 28.

Alternatively in the personal hygiene device 20 as well as those embodiments which follow, a wider individual sheet 54 (dotted lines) may replace one of the individual sheets 42 with a thicker absorbent pad 56 (dotted lines) of a rounded cross-sectional shape to provide more absorbency and comfort cleaning the person's recto-genital area 24. Further alternatively, a still wider individual sheet 58 (dotted lines) may replace one of the individual sheets 42 with a still thicker absorbent pad 60 (dotted lines) of a semi-circular cross-sectional shape to help the person 22 reach between respective cheeks 62 and 64 of the person's buttocks 66 to clean the recto-genital area 24.

Respective of the end portions 44 of the individual sheets 42 are folded over and affixed together at respective pluralities of transverse end seams 68 to form respective reinforced ends 70 adapted to be gripped in-hand with the thumb holes 38 extending therethrough adapted to receive respective of the person's thumbs 40. Alternatively, the strip 26 may comprise a single first alternative individual sheet 72 (shown separately at the dotted lines) which is the size of two of individual sheets 42 and is doubled-over on itself along a longitudinal portion 74 and affixed to itself at a single longitudinally extending side seam 76. The seams 48, 50, 68, and 76, as well as those in the embodiments of the personal hygiene devices which follow, are formed using a process such as: adhesive bonding in straight lines as shown, a uniform continuous layer of adhesive, a patterned layer of adhesive, or an array of separate lines, spirals, or spots of adhesive; heat bonding; pressure bonding; ultrasonic bonding; dynamic mechanical bonding; combinations thereof; and any other suitable bonding process.

Pad 28 has a middle portion 78 and respective end portions 80 and is relatively thin and of a substantially rectangular shape adapted to fit within the central compartment 52. Pad 28, as well as pads 56 and 60 and those in the embodiments of the personal hygiene devices which follow, is preferably about sixteen inches long and of a width to fit the strip 26 as shown. The absorbent pad 28, 56, and 60, whichever is used, is retained at the middle portion 30 of the strip 26 to provide additional absorbency to the middle portion 30. Pads 28, 56, and 60, as well as those in the embodiments of the personal hygiene devices which follow are preferably made of a flushable material. Suitable flushable and non-flushable materials include cotton, tissue wraps, tissue laminates, comminuted wood pulp, creped cellulose wadding, meltblown polymers, cellulosic fibers, absorbent foams, absorbent sponges, superabsorbent polymers, absorbent gelling materials, combinations thereof, and other such commonly used absorbent materials.

In personal hygiene device 20 as well as those which follow, one or both of the strip 26 and the absorbent pad 28, 56, or 60 may include one or more skin treatment ingredients such as water mixed with various combinations of ingredients such as moistening agents or humectants, anti-microbial agents, skin protectants such as glycerine, pH-adjusting agents, fragrances, emollients, surfactants, emulsifiers, and the like. These skin treatment ingredients help sooth the skin, kill bacteria, provide a nice scent, and the like for the skin of the recto-genital area 24 of the person 22 in addition to removing excrement.

Again referring to FIGS. 1 and 2, the personal hygiene device 20 is used by the person 22 to clean the recto-genital area 24 by gripping the reinforced end portions 70 of strip 26 in-hand, optionally by placing one of the person's thumbs 40 through one of the thumb holes 38 of one reinforced end 70, adjacent the person's lower torso area 82. The other of the person's thumbs 40 is placed through the other thumb hole 38 of the other reinforced end 70 adjacent the person's lower buttocks area 84 with the middle portion 30 thereof extending from front to back between the user's legs 34 and 36. This may be done while the person 22 is still seated on the toilet. The person 22 then stands and the middle portion 30 of strip 26 is moved into engagement with the recto-genital area 24 by raising the reinforced ends 70 upwardly to place the absorbent middle portion 30 of strip 26 with the frontmost of end portions 80 of the absorbent pad 28 juxtaposed a front portion 86 of the recto-genital area 24. With the strip 26 in tension by oppositely pulling on the reinforced ends 70 to gently but firmly engage the recto-genital area 24, the person 22 moves the end portions 32 of strip 26 longitudinally toward a rear portion 88 of the recto-genital area 24 while maintaining tension thereon to wipe the middle portion 30 thereof along the recto-genital area 24 no further than until the other end portion 80 of pad 28 reaches the rear portion 88 of the recto-genital area 24 to remove excrement in the form of urine, feces, menses, or sweat therefrom following urination, defecation, menstruation, or sweating. Preferably women move the personal hygiene device 20 from front to rear only in a single motion to help prevent bladder or urethral infections from the feces. Men may use a reciprocating motion from front to back. The personal hygiene device may be dropped into a toilet and flushed without contacting the urine, feces, menses, or sweat contaminated middle portion 30 by releasing the person's thumbs 40 from the thumb holes 38.

The personal hygiene device 20, as well as those embodiments and hygiene device sheets which follow, may be folded or rolled up to provide a compacted, more compact unit and not individually packaged such as for sale in bulk or individually packaged for convenient, more sanitary dispensing. Individually packaged personal hygiene devices may be in a tear-away wrapper (not shown) made of foil, a plastic bag or pouch with or without a closing flap which may be adhesively secured closed following packaging, sheet plastic such as cellophane or vinyl, paper, or the like. Any of these may be packaged in desired numbers in a carrying pouch, in a cardboard dispenser with tear-away panel for individual dispensing, loaded into a disposable or reusable wall mounted dispenser, or other suitable multiple packaging/dispensing device. The individually packaged personal hygiene devices 20 are easily concealed within a purse, clothing pocket, or the like for confidential later use and disposal by flushing down a toilet.

Referring to FIGS. 5 and 6, therein is shown a second embodiment personal hygiene device 90 for use by the person 22 to clean their recto-genital area 24 which is of flexible comprised of an elongated flexible strip 92 and the elongated absorbent pad 28, though pads 56 and 60 may be used. The strip 92 includes an absorbent middle portion 94 adapted to engage the recto-genital area 24, and respective dependent end portions 96 adapted to be gripped in-hand by the person 22. The strip 92 is of a length sufficient for the middle portion 94 to extend between the person's legs 34 and 36 and of a width as stated above for strip 26. The end portions 96 are adapted to be gripped in-hand by having respective thumb holes 98 therethrough adapted to receive respective of the user's thumbs 40 therethrough.

The strip 92 is of an elongated tubular shape, preferably being comprised of a pair of a single elongated wider individual sheet 100 which includes respective end portions 102 adapted to be gripped in-hand interconnected by a middle portion 104 adapted to retain the absorbent pad 28. The individual sheet 100 is longitudinally rolled to form the tubular shape which is affixed to itself at a longitudinally extending side seam 106, particularly the middle portion 104, to form an elongated, thin walled tube 108. The individual sheet 100 is then flattened and the end portions 102 affixed together at respective pluralities of transverse intermediate seams 110 to form an elongated central compartment 112 therebetween which is relatively thin and of substantially rectangular shape adapted to contain the absorbent pad 28.

Respective of the end portions 102 of the individual sheet 100 are folded over and affixed together at respective pluralities of transverse end seams 114 to form respective reinforced ends 116 adapted to be gripped in-hand with the thumb holes 98 extending therethrough adapted to receive respective of the person's thumbs 40.

The absorbent pad 28, 56, and 60, whichever is used, is retained at the middle portion 94 of the strip 92 to provide additional absorbency to the middle portion 94.

The personal hygiene device 90 is used by the person 22 to clean the recto-genital area 24 as described above for the personal hygiene device 20.

Referring to FIGS. 7 and 8, therein is shown a third embodiment personal hygiene device 118 for use by the person 22 to clean their recto-genital area 24 which is of flexible construction comprised of an elongated flexible strip 120 and the elongated absorbent pad 28, though pads 56 and 60 may be used. The strip 120 includes an absorbent middle portion 122 adapted to engage the recto-genital area 24, and respective dependent end portions 124 adapted to be gripped in-hand by the person 22. The strip 120 is of a length sufficient for the middle portion 122 to extend between the person's legs 34 and 36 and of a width as stated above for strip 26. The end portions 124 are adapted to be gripped in-hand by having respective thumb holes 126 therethrough adapted to receive respective of the user's thumbs 40 therethrough.

The strip 120 is comprised of a single elongated individual sheet 128 which include respective end portions 130 adapted to be gripped in-hand interconnected by a middle portion 132 adapted to retain the absorbent pad 28. The individual sheet 128 may be slightly thicker than the individual sheets 42 and 100 since only one material thickness is used rather than two.

Respective of the end portions 130 of the individual sheet 128 are folded over and affixed together at respective pluralities of transverse end seams 134 to form respective reinforced ends 136 adapted to be gripped in-hand with the thumb holes 126 extending therethrough adapted to receive respective of the person's thumbs 40.

The absorbent pad 28, 56, and 60, whichever is used, is affixed to the middle portion 122 of the strip 120 at a plurality of transverse pad attachment seams 138 to provide additional absorbency to the middle portion 122.

The personal hygiene device 118 is used by the person 22 to clean the recto-genital area 24 as described above for the personal hygiene device 20.

Referring to FIGS. 9 and 10, therein is shown a plurality of fourth embodiment personal hygiene devices 140 for use by the person 22 to clean their recto-genital area 24 which is of flexible construction as part of a hygiene device sheet 142. The hygiene device sheet 142 is adapted for mass production using automated manufacturing equipment from rolls of raw sheet material such as a pair of upper and lower sheets 144 and 146 of raw strip material and a middle sheet 148 of raw padding material extending from respective rolls of raw sheet material (not shown) using automated manufacturing equipment. Adjacent of the personal hygiene devices 140 are initially interconnected edgewise at respective weakened tear planes 150 adapted to permit separation of the personal hygiene devices 140 therealong for individual use thereof.

The personal hygiene devices 140 are each comprised of an elongated flexible strip 152 and an elongated absorbent pad 154, though pads similar to pads 56 and 60 may be used. The strip 152 includes an absorbent middle portion 156 adapted to engage the recto-genital area 24, and respective dependent end portions 158 adapted to be gripped in-hand by the person 22. The strip 152 is of a length sufficient for the middle portion 156 to extend between the person's legs 34 and 36 and of a width as stated above for strip 26. The end portions 158 are adapted to be gripped in-hand by having respective thumb holes 160 therethrough adapted to receive respective of the user's thumbs 40 therethrough.

The strip 152 is comprised of a pair of elongated individual sheets 162 and 164 formed from respective of the upper and lower sheets 144 and 146 of raw strip material which include respective end portions 166 and 168 adapted to be gripped in-hand interconnected by respective middle portions 170 and 172 adapted to retain the absorbent pad 154. Adjacent of the individual sheets 162 and 164 of the upper and lower strip material sheets 144 and 146 are initially interconnected edgewise at respective weakened tear lines, preferably in the form of perforated lines 174 and 176. The end portions 166 and 168 of the individual sheets 162 and 164 are affixed together at respective pluralities of transverse intermediate seams 178 to form an elongated central compartment 180 therebetween which is open-sided upon separation of adjoining of the personal hygiene devices 140 along the tear planes 150, relatively thin, and of substantially rectangular shape adapted to contain the absorbent pad 154.

Respective of the end portions 166 and 168 of the individual sheets 162 and 164 are folded over and affixed together at respective pluralities of transverse end seams 182 to form respective reinforced ends 184 adapted to be gripped in-hand with the thumb holes 160 extending therethrough adapted to receive respective of the person's thumbs 40.

The pads 154 are formed from the middle sheet 148 of raw padding material, each having a middle portion 186 and respective end portions 188, and are relatively thin and of a substantially rectangular shape adapted to fit within the central compartments 180. Adjacent of the pads 154 of the middle sheet 148 are initially interconnected edgewise at respective weakened tear lines, preferably in the form of perforated lines 190. The pads 154 are affixed to the middle portion 156 of the strip 152 at respective pluralities of transverse pad attachment seams 191 to retain the pads 154 within the central compartments 180 and provide additional absorbency to the middle portion 156.

The perforated lines 174, 176, and 190 respectively of the upper and lower sheets 144 and 146 of raw strip material and the middle sheet 148 of raw padding material are aligned to form the single weakened tear plane 150 adapted to permit separation of the personal hygiene devices 140 therealong for individual use thereof.

The hygiene device sheet 142 may be automatically mechanically separated along the weakened tear planes 150 into individual of the personal hygiene devices 140, then folded and packaged as described above.

The personal hygiene devices 140 are used by the person 22 to clean the recto-genital area 24 as described above for the personal hygiene device 20.

Referring to FIGS. 11 and 12, therein is shown a fifth embodiment personal hygiene device 194 for use by the person 22 to clean their recto-genital area 24 which is of flexible construction as part of a hygiene device sheet 196. The hygiene device sheet 196 is adapted for mass production using automated manufacturing equipment from rolls of raw sheet material such as a pair of upper and lower sheets 198 and 200 of raw strip material and a middle sheet 202 of raw padding material extending from respective rolls of raw sheet material (not shown) using automated manufacturing equipment. Adjacent of the personal hygiene devices 194 are initially interconnected edgewise at respective weakened tear lines, preferably in the form of perforated lines 204 adapted to permit separation of the personal hygiene devices 194 therealong for individual use thereof.

The personal hygiene devices 194 are each comprised of an elongated flexible strip 206 and an elongated absorbent pad 208, though pads similar to pads 56 and 60 may be used. The strip 206 includes an absorbent middle portion 209 adapted to engage the recto-genital area 24, and respective dependent end portions 210 adapted to be gripped in-hand by the person 22. The strip 206 is of a length sufficient for the middle portion to extend between the person's legs 34 and 36 and of a width as stated above for strip 26. The end portions 210 are adapted to be gripped in-hand by having respective thumb holes 212 therethrough adapted to receive respective of the user's thumbs 40 therethrough.

The strip 206 is comprised of a pair of elongated individual sheets 214 and 216 formed from respective of the upper and lower sheets 198 and 200 of raw strip material which include respective end portions 218 and 220 adapted to be gripped in-hand interconnected by respective middle portions 222 and 224 adapted to retain the absorbent pad 208. Adjacent of the individual sheets 214 and 216 of the upper and lower sheets 198 and 200 of raw strip material are initially interconnected edgewise at respective weakened tear lines, preferably in the form of perforated lines 226 and 228. The end portions 218 and 220 of the individual sheets 214 and 216 are affixed together at respective pluralities of transverse intermediate seams 230 to form an elongated central compartment 232 therebetween which is relatively thin and of substantially rectangular shape adapted to contain the absorbent pad 208.

Respective of the end portions 218 and 220 of the individual sheets 214 and 216 are folded over and affixed together at respective pluralities of transverse end seams 234 to form respective reinforced ends 236 adapted to be gripped in-hand with the thumb holes 212 extending therethrough adapted to receive respective of the person's thumbs 40.

The pads 208 are formed from the middle sheet 202 of raw padding material, each having a middle portion 238 and respective end portions 240, and are relatively thin and of a substantially rectangular shape adapted to fit within the central compartment 232. Adjacent of the pads 208 of the middle sheet 202 are initially interconnected edgewise at respective weakened tear lines, preferably in the form of perforated lines 242. The pads 208 are separated along respective of the perforated lines 242 during manufacture of the hygiene device sheet 196 and the individual sheets 214 and 216, particularly the middle portions 222 and 224, are affixed together at respective longitudinally extending side seams 244 to close the central compartment 232.

The perforated lines 226 and 228 of the individual sheets 214 and 216 are aligned to form the single perforated lines 204 adapted to permit separation of the personal hygiene devices 194 therealong for individual use thereof.

Alternatively, the side seams 244 of adjacent personal hygiene devices 194 may each comprise a single wider side seam 246 with the perforated line 204 disposed centrally therealong such that a portion of the wider side seam 246 remains with adjacent personal hygiene devices 194 upon separation thereof to maintain the closed integrity of the central compartments 232.

The hygiene device sheet 196 may be automatically mechanically separated along the perforated lines 204 into individual of the personal hygiene devices 194, then folded and packaged as described above.

The personal hygiene devices 194 are used by the person 22 to clean the recto-genital area 24 as described above for the personal hygiene device 20.

Many variations to the personal hygiene devices of the present invention are possible while staying within the same inventive concept. For example, the pads may be of a multiple layer construction, such as a soft outer layer and an absorbent inner layer for greater comfort or a cloth outer layer which contains a conventional super-absorbent material. The strip and the absorbent pad may be of different shapes, such as the strip being slightly narrower at the middle portion than at the end portions and the pad having rounded end portions and a narrower middle portion. One of the individual sheets may be made of a plastic film material to provide additional strength, and to prevent urine, watery feces, menses, or sweat from penetrating from the opposite absorbent individual sheet, through the pad, and completely through to the strip, such as polyvinyl alcohol, methyl cellulose, or other slowly hydratable resinous material suitable for flushing down toilets. The individual sheets or any portion thereof may be embossed and/or matte finished to provide a more cloth-like appearance.

The personal hygiene devices of the present invention thus solve all of the above-enumerated problems of the prior art devices to aid physically impaired users to clean their recto-genital area such as following excretion such as, defecation, urination, menstruation, and sweating. The personal hygiene devices are easy to grip in-hand by the option of slipping the person's thumbs through the thumb holes which does not require gripping strength by persons having arthritic or palsied hands. The personal hygiene devices are placed between the person's legs which virtually automatically places the personal hygiene device into proper position at the recto-genital area. Further, applying proper pressure and manipulating the personal hygiene device front to rear to wipe the recto-genital area is easy by using both hands and arms at opposite ends thereof. The personal hygiene devices are completely disposable by flushing down the toilet so as not to be subject to contamination. The personal hygiene devices may be folded or rolled and individually wrapped or otherwise packaged so as to be compact so as to be portable in a discrete manner in a purse or pocket, or the like for subsequent use and disposal. The personal hygiene devices are inexpensive to manufacture as hygiene device sheets using inexpensive materials and automated manufacturing equipment.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A personal hygiene device to aid physically impaired users to clean their recto-genital area, comprising:

an elongated absorbent pad of a length between twelve and twenty inches;

an elongated flexible strip between thirty and forty-two inches long and between one and one-half inches and two and one-half inches wide, said strip comprising:

a middle portion comprising a pocket for retaining the pad at a position substantially centered along the flexible strip;

at least one sheet which is doubled-over on itself along a longitudinal fold and having a longitudinally extending side seam which forms the pocket;

a first end portion extending from the middle portion in a first direction and having a distal end adapted to be gripped by a first hand of the user; and a second end portion extending from the middle portion in a direction opposite the first direction and having a distal end adapted to be gripped by a second hand of the user;

wherein the distal ends of the first and second end portions are folded back toward the center of the flexible strip and affixed to the respective end portions to form respective reinforced ends;

the reinforced end portions each including a respective thumb hole adapted to receive a respective one of the user's thumb's therethrough;

the first and second end portions of the flexible strip further including at least one transverse intermediate seam; and wherein both the flexible strip and the absorbent pad are each comprised of a material which is suitable to be flushed down a toilet after a single use.

2. The personal hygiene device according to claim 1, wherein at least one of the strip and the absorbent pad includes at least one skin treatment ingredient chosen from the group consisting of water, moistening agents, humectants, anti-microbial agents, skin protectants, pH-adjusting agents, fragrances, emollients, surfactants, and emulsifiers.

3. The personal hygiene device according to claim 1, wherein the device is used by moving said end portions longitudinally, thereby cleaning the recto-genital area in a single wipe in one longitudinal direction.

4. The personal hygiene device according to claim 1, wherein at least one of the strip and the pad includes one or more skin treatment ingredients for application to the recto-genital area.

5. The personal hygiene device according to claim 1, wherein the flexible strip further comprises:

a first side adapted to engage the recto-genital area; and a second side comprising a plastic film material to prevent the passage of urine, watery feces, menses, or sweat.

6. The personal hygiene device according to claim 5, wherein the first and second end portions may be folded over the middle portion so as to completely conceal the first side after use but prior to disposal.

* * * * *